US006009957A

United States Patent [19]

Esko et al.

[11] Patent Number: 6,009,957

[45] **Date of Patent: *Jan. 4, 2000**

[54] ARRANGEMENT IN A FEED BEAM OF A ROCK DRILL

[75] Inventors: Mauri Esko, Ikaalinen; Heikki Jantunen, Tampere; Timo Laitinen, Viiala; Leo Häkkinen, Tampere, all of Finland

[73] Assignee: Tamrock Oy, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/913,512

[22] PCT Filed: Mar. 15, 1996

[86] PCT No.: PCT/FI96/00158

§ 371 Date: Nov. 20, 1997

§ 102(e) Date: Nov. 20, 1997

[87] PCT Pub. No.: WO96/29503

PCT Pub. Date: Sep. 26, 1996

[30] Foreign Application Priority Data

Mar. 17, 1995 [FI] Finland ..... 951271

[51] Int. Cl.[7] ..... F16C 29/02

[52] U.S. Cl. ..... 173/4; 173/38; 173/42; 173/171

[58] Field of Search ..... 173/138, 4, 42, 173/193, 171; 384/41, 42

[56] References Cited

U.S. PATENT DOCUMENTS

| | | | |
|---|---|---|---|
| 1,981,992 | 11/1934 | Curtis | 384/41 |
| 3,650,576 | 3/1972 | Hughes | 384/41 |
| 4,184,719 | 1/1980 | Ward | 384/42 |
| 4,682,899 | 7/1987 | Andersson | 384/42 |
| 4,925,320 | 5/1990 | Foster et al. | 384/42 |
| 5,000,271 | 3/1991 | Uitto | 173/42 |
| 5,549,390 | 8/1996 | Reitberger | 384/42 |
| 5,560,713 | 10/1996 | Christenson | 384/42 |

*Primary Examiner*—Peter Vo
*Assistant Examiner*—James P. Calve
*Attorney, Agent, or Firm*—Nixon & Vanderhye P.C.

[57] ABSTRACT

In the arrangement, a feed beam made of an aluminum profile comprises a slide guide frame, whereby the outer surface of the slide guide frame and respectively, the inner surface of the slide guide are shaped and dimensioned in such a manner that when the slide guide is on the slide guide frame, they are tight against one another. The other edge of the slide guide flame and respectively, the corresponding edge of the slide guide are shaped in such a manner that when the slide guide is mounted in place, its edge is shape-locked relative to the slide guide frame. The slide guide is also secured by separate securing mechanism to the feed beam in such a manner that it cannot move either in the cross or longitudinal direction relative to the feed beam.

5 Claims, 2 Drawing Sheets

ARRANGEMENT IN A FEED BEAM OF A ROCK DRILL

TECHNICAL FIELD

The invention relates to an arrangement in a feed beam of a rock drill, the arrangement comprising a feed beam which is provided with at least one slide guide frame on both sides of the feed beam and a slide guide profile of steel placed on each slide guide frame, whereby the inner surface of the slide guide profile and the outer surface of the slide guide frame of the feed beam are essentially in contact with each other.

BACKGROUND OF THE INVENTION

It is well known that the feed beam of the rock drill comprises slide guides along which the carriage of the rock drill slides when moving backwards and forwards along the feed beam. Similarly, in telescopic feed beams the parts of the feed beam move relative to one another along corresponding slide guides and the end beam may also move relative to the cradle at the end of the boom along corresponding slide guides. When the weight at the end of the boom is to be reduced, feed beams made of a light metal mixture have been used to reduce their weight. As a consequence of this, it is essential that separate steel slide guides or profiles providing the surface of the slide guide are secured to the feed beams because the wear resistance of light metal is clearly not sufficient in drilling conditions. An arrangement of this kind is known e.g. from Swedish Published Specification 444 346.

The above identified Swedish Published Specification discloses a solution in which the profile of an aluminum feed beam is shaped at the slide guide to be such that in addition to the surfaces of the slide guides at an angle relative to one another, it comprises surfaces narrowing away from the slide guides. The slide guide is made of a flexible steel profile which can be pushed to its place in the cross direction of the feed beam. In this case, the feed beam yields and is able to slide into its place and when it settles into its place, it presses against the surfaces of the feed beam and remains in place by its springback factor. A problem of this solution is that in order to implement cross directional mounting, the steel profile to be used has to be made of a very thin material. As a result of this, it easily works up during use because of damaging and for other reasons, whereby it bends and tends to straighten so that its springback factor weakens and it may fall off. Further, because of securing by the springback factor, the slide profile may slightly move relative to the beam and as a result, the dust between the profile and the feed beam may wear the end beam fast at the same time as the changes of form in the profile will be faster and thus the service life of the feed beam and slide profile will become shorter. Also, in situations in which the slide pieces or the carriage of the rock drill are clamped too tight against the slide guide, it may cause the slide guide to jolt and thus it will be permanently damaged at once.

SUMMARY OF THE INVENTION

The object of this invention is to provide an arrangement with which the problems mentioned above can be avoided and which is reliable and easy to implement. The arrangement according to the invention is characterized in that the other edge of the slide guide frame and respectively, the corresponding edge of the slide guide profile are shaped in such a manner that when the slide guide is in place on the slide guide frame, the edge of the slide guide profile is shape-locked relative to the edge of the slide guide frame; that the slide guide frame and the slide guide profile are shaped in such a manner that the slide guide can be placed in the cross direction of the feed beam against the slide guide frame without bending the slide guide profile in its cross direction; and that the arrangement comprises securing means with which the slide guide profile is secured to the feed beam stationary relative to it.

The essential idea of the invention is that the feed beam is provided with such a cross section of the profile part formed by the slide guide of the feed beam that the steel profile forming the slide guide can be placed on it without having to extend it in any way when mounting in place, but in which when the slide guide is in place, the other edge of the feed beam is locked by the shape of the feed beam and by its own shape and thus cannot be unlocked. It is also essential to the arrangement according to the invention that the slide guide is locked separately to the feed beam with locking means so that it cannot become unlocked and thus detached from its place without the locking means being removed first.

An advantage of the arrangement according to the invention is that the slide guide profile can be formed of a sufficiently thick material into its final shape, whereby it is easy and uncomplicated to mount in place and the slide guide need not be stressed in any way in the cross direction of its profile either at the mounting stage or when detaching it. A further advantage is that when the profile is secured separately to the feed beam, it cannot move either in the longitudinal or cross direction so that it would abrade the feed beam and thus wear it.

The invention will be explained in more detail in the accompanying drawings.

DETAILED DESCRIPTION OF THE INVENTION

Figure 1:
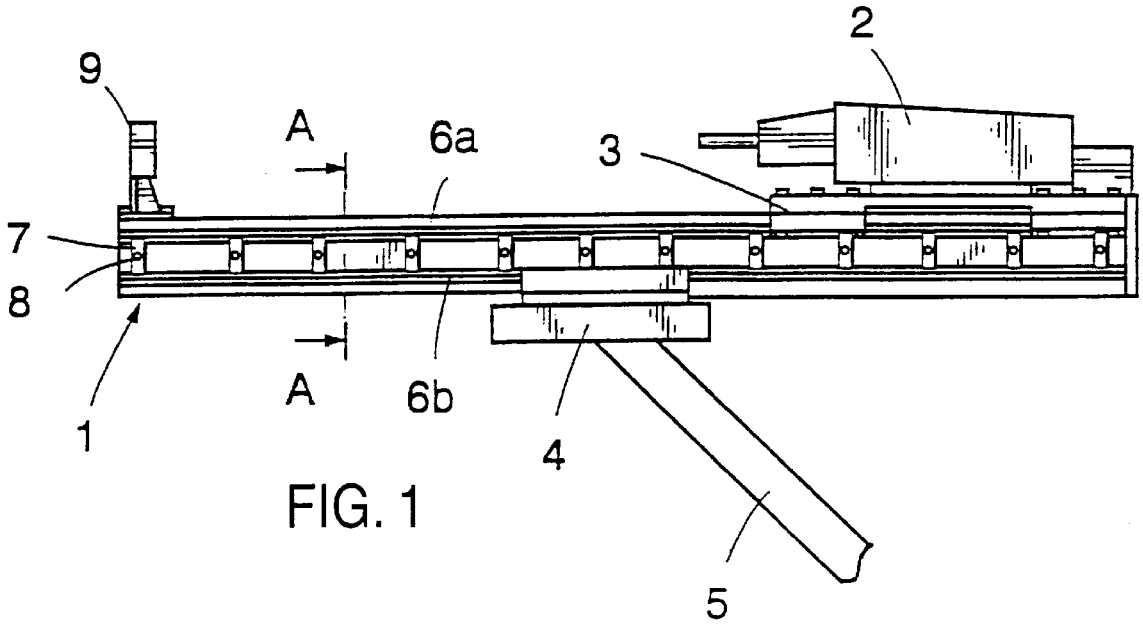
FIG. 1 shows a schematic view of the feed beam comprising the arrangement according to the invention.

FIG. 1 shows a schematic view of feed beam 1 on which a rock drill 2 moves on a carriage 3 mounted slidably to the feed beam. The feed beam 1 is further mounted slidably in its longitudinal direction on a cradle 4. Regulating units and feed equipment needed for transferring the feed beam and the rock drill 2 are otherwise in general fully known per se to those skilled in the art, and therefore will not be explained more closely herein.

The feed beam 1 is provided in both its upper and lower edge with slide guides 6*a* and 6*b* which are steel profiles mounted on the feed beam 1. In this embodiment of the invention, the slide guides 6*a* and 6*b* are secured to the feed beam 1 by securing pieces 7 which are secured by bolts 8. The figure further shows a drill rod centralizer 9 at the front end of the feed beam 1. A drill rod centralizer of this kind is in general fully known per se, and therefore will not be explained more closely herein.

Figure 2:
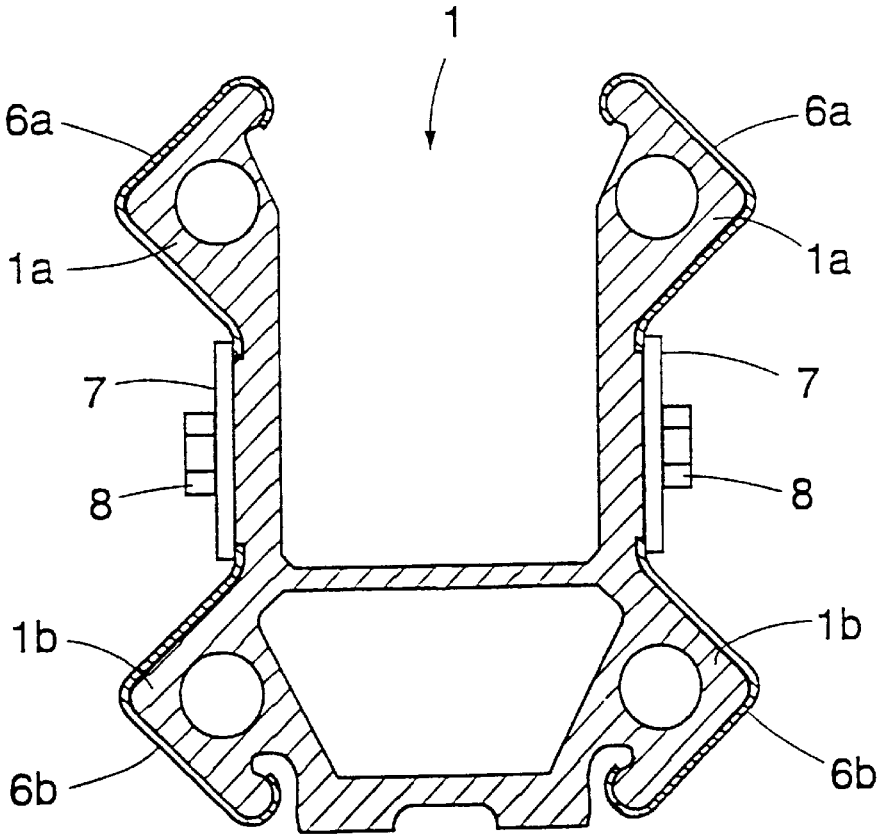
FIG. 2 shows a schematic sectional view of the feed beam according to FIG. 1 along line A—A.

FIG. 2 shows a cross-section of the feed beam according to FIG. 1 along line A—A indicates thereto. As can be seen in FIG. 2, the feed beam 1 is preferably a light metal mixture profile the upper and lower edges of which are on both sides provided with slide guide bodies 1*a* and 1*b* with essentially triangular outer surfaces. At their outermost edges, that is, in the figure on the upper edge of the feed beam 1 and respectively, on the lower edge, the slide guide bodies 1*a* and 1*b* are shaped like curves in their cross-section and preferably, like circular arcs. Correspondingly, at the other end of both slide guide bodies 1*a* and 1*b* there is a recess inwards from the outer surface of the feed beam 1 the height of which is essentially the same as the thickness of the slide guide 6*a,* 6*b*. The slide guides 6*a* and 6*b* are of such a cross section that, according to the figure, when they are in place, they are placed tight against the outer surface of the slide guide bodies 1*a* and 1*b,* whereby the part of the slide guides 1*a* and 1*b* at the outer edges of the feed beam 1 is locked in place by means of so-called shape-locking and it cannot thus move in the cross direction of the feed beam 1. The other edges of the slide guides 6*a* and 6*b* are secured to the feed beam 1 by securing pieces 7 which are placed on the edges of the slide guides 6*a* and 6*b* and which are secured to the feed beam 1 by bolts 8 in such a manner that they clamp the edges of the slide guides tight against the feed beam 1. When there are securing pieces at suitable distances, the slide guides 6*a* and 6*b* will be very steadily and firmly stationary in place relative to the feed beam 1. When the slide guide profile 6*a* and 6*b* is mounted in place, the slide surfaces or the slide surfaces of the slide pieces of the rock drill carriage 3 are placed against the projected surfaces of the slide guide profile in an angle relative to one another and slides on them. This structure and operation is in general fully known per se, wherefore it will not be explained in more detail herein.

Figure 3A:
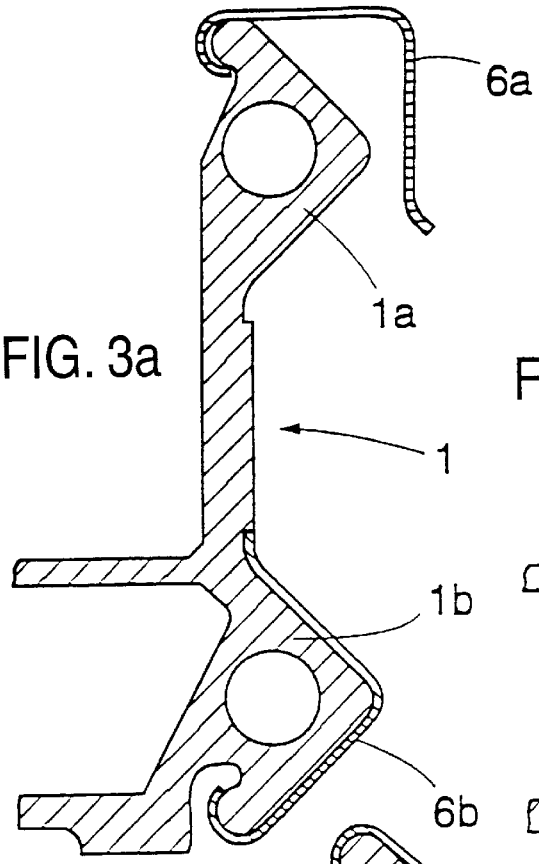
FIGS. 3*a* to 3*c* show schematic views of mounting the slide guide to the feed beam in the manner shown in the arrangement according to the invention.
Figure 3B:
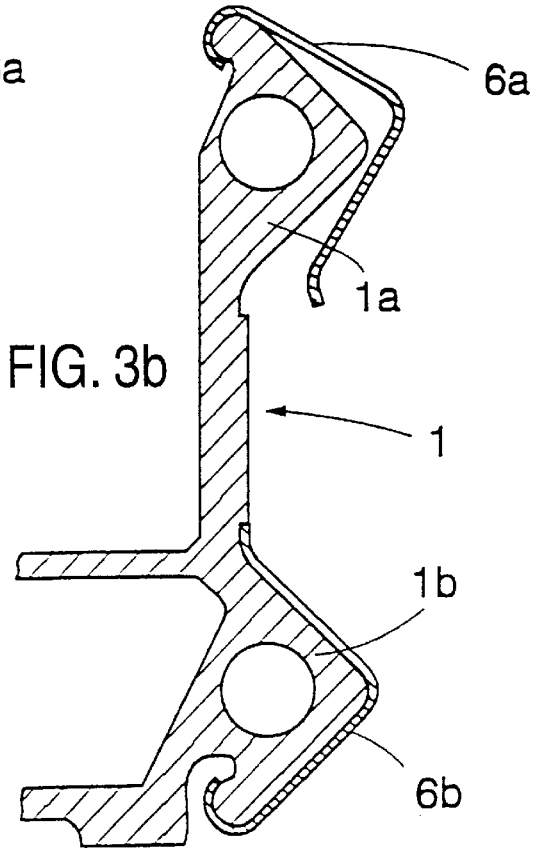
Figure 3C:
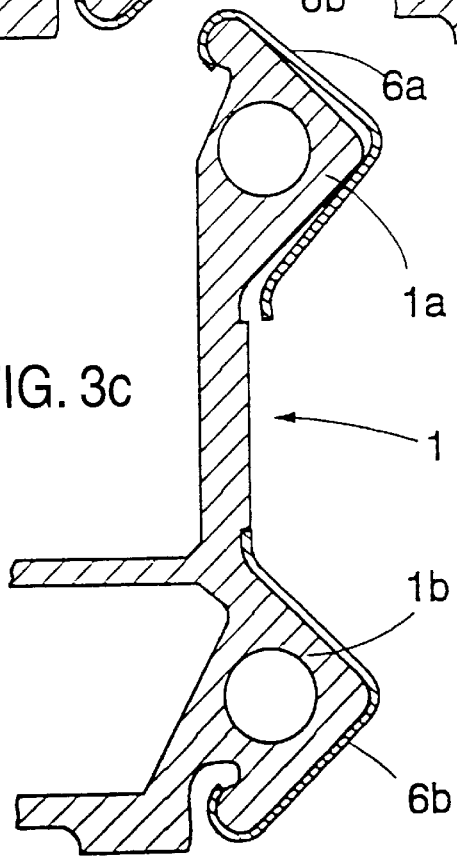

FIGS. 3*a* to 3*c* show schematic views of how the slide guide 6*a* is placed on the slide guide frame 1*a* of the feed beam 1. The feed beam is in these figures shown only in those parts that are necessary for illustration.

FIG. 3*a* shows how the slide guide 6*a* is mounted on the slide guide frame 1*a* in the upper part of the feed beam in such a manner that the curved edge of the slide guide 6*a* is placed on the curved part of the slide guide frame 1*a* tight against its surface. In this situation, the slide guide 6*a* can be turned relative to the curved surface in the direction shown in FIG. 3*b* in such a manner that the slide guide 6*a* starts to turn on the slide guide frame 1*a*. As can be seen in FIG. 3*c,* when the slide guide 6*a* gets closer to the slide guide frame 1*a,* it is spaced against its surface without the slide guide 6*a* having to extend in any way or having to yield in its cross direction. When the slide guide 6*a* is turned to the end, it is, as the slide guide 6*b* in the lower part of FIGS. 3*a* to 3*c,* tight against the surface of the slide guide frame 1*a* and can be secured in place as is shown, above in FIGS. 1 and 2. In this case, the slide guide 6*a* is at its upper edge shape-locked relative to the slide guide frame 1*a* and remains fast in place.

Figure 4:
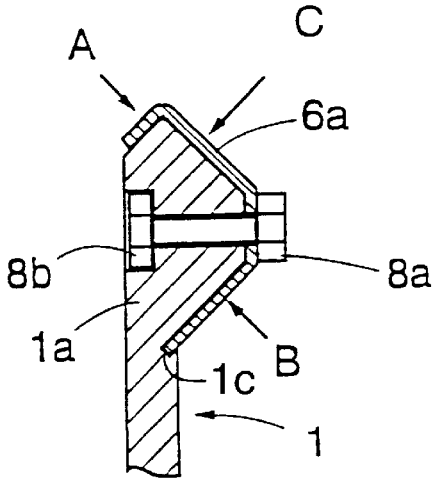
FIG. 4 shows a schematic view of another embodiment of the invention.

FIG. 4 shows a schematic view of another embodiment of the invention. This figure shows by way of example only the slide guide frame 1*a* of the feed beam 1 and the slide guide 6*a* secured thereto. As can be seen in the figure, the slide guide 6*a* is in this case angular in shape, whereby the short part indicated by arrow A at the upper edge and respectively, the other part indicated by arrow B comprising the slide surface are parallel. Correspondingly, the slide guide frame 1*a* comprises two parallel surfaces so that the slide guide 6*a* can be pushed in place on the slide guide frame 1*a* in the direction of its parts A and B. The slide guide 6*a* is further secured to the feed beam 1 by bolts 8*a* an nuts 8*b* screwed through the slide guide frame 1*a,* whereby it remains steadily in place. At the same time, it cannot move in the direction of its parts A and B, whereby the upper part of the slide guide 6*a,* that is, the part facing the upper edge of the feed beam is shape-locked in place. Correspondingly, the lower edge of the slide guide 6*a* extends to a recess 1*c* in the feed beam, whereby it is also locked in place and cannot project from its place.

The invention is above in the specification and in the drawings shown only by way of example and it is in no way restricted to it. It is essential to the invention that the slide guide frame of the feed beam and respectively, the slide guide are of such a shape that they clamp tight against one another when the slide guide is mounted in place. It is also essential that the slide guide can be mounted in place either by turning or pushing so that the slide guide need not be stretched or extended in its cross direction to insert it. It is further essential to the invention that the other edge of the slide guide and the slice guide frame are of such a shape that the other edge of the slide guide is shape-locked to the slide guide frame when it is in place. The invention is most preferable when implemented in such a way that that a feed beam profile of light metal mixture is used. However, in some cases it is preferable to apply the invention also to feed beams of a steel structure, whereby the wear of the slide guides does not require that the whole feed beam to be reinstalled but the new slide guide surfaces are easy to install by extracting the old slide guides and by inserting the new slide guides in their place. In this way, the service and maintenance of feed beams of steel structure are made easier and less complicated.

What is claimed is:

1. An arrangement in a feed beam of a rock drill, said arrangement comprising a feed beam provided on each of two opposite sides thereof with at least one slide guide frame having a pair of outer surfaces angled with respect to each other, and a discrete slide guide profile placed on each slide guide frame, each slide guide profile having a pair of inner surfaces angled with respect to each other, whereby said inner surfaces of the slide guide profile and said outer surfaces of the slide guide frame of the feed beam are in contact with each other, and wherein an edge of the slide guide frame and a corresponding edge of the slide guide profile are shaped in such a manner that when the slide guide profile is in place on the slide guide frame, said corresponding edge of the slide guide profile is shape-locked relative to the edge of the slide guide frame, wherein an opposite edge of the slide guide profile is not shape locked to the slide guide frame and further wherein the slide guide frame and the slide guide profile are shaped in such a manner that when the slide guide profile is placed in a cross direction of the feed beam against the slide guide frame the slide guide profile does not bend in a cross direction; said arrangement further comprising securing means with which said opposite edge of the slide guide profile is secured to the slide guide frame of the feed beam.

2. The arrangement according to claim 1, wherein said edge of the slide guide frame is curved in cross-section, and the corresponding edge of the slide guide profile is similarly curved in such a manner that the slide guide profile can be placed on the slide guide flame and turned into place against the slide guide frame.

3. The arrangement according to claim 2, wherein the securing means include separate securing pieces which are placed on the slide guide profile and which are secured by bolts to the feed beam in such a manner that the slide guide profiles are clamped against the feed beam.

4. The arrangement according to claim 6, wherein each slide guide frame has a third outer and substantially straight surface at its outermost edge which is parallel to one of said pair of outer surfaces of said slide guide frame, and wherein each slide guide profile has a third inner surface parallel to one of said pair of inner surfaces of said slide guide profile creating two parallel sides such that the slide guide profile can be pushed on the slide guide frame in a direction of said parallel sides, and further wherein the securing means include a plurality of bolts with which the slide guide is secured to the feed beam.

5. The arrangement according to claim 4, wherein a recess is provided in the feed beam adjacent to the slide guide frame and further wherein said opposite edge of the slide guide profile can be pushed into said recess when inserting the slide guide profile onto the slide guide frame.

* * * * *